US008464474B2

(12) United States Patent
Johnson

(10) Patent No.: US 8,464,474 B2
(45) Date of Patent: Jun. 18, 2013

(54) SELF CLEANING GUTTER SYSTEM

(76) Inventor: Roland S Johnson, Mt. Laurel, NJ (US)

( * ) Notice: Subject to any disclaimer, the term of this patent is extended or adjusted under 35 U.S.C. 154(b) by 142 days.

(21) Appl. No.: 12/924,414

(22) Filed: Dec. 10, 2010

(65) Prior Publication Data

US 2012/0144607 A1 Jun. 14, 2012

(51) Int. Cl.

| | |
|---|---|
| ***E04D 13/00*** | (2006.01) |
| ***E04D 13/08*** | (2006.01) |
| ***E04D 15/00*** | (2006.01) |
| ***E04B 1/70*** | (2006.01) |

(52) U.S. Cl.
USPC ..... 52/11; 52/12; 52/15; 52/16; 52/97; 52/302.1; 52/302.3

(58) Field of Classification Search
USPC ..... 52/11, 12, 15, 16, 97, 302.1, 302.3
See application file for complete search history.

(56) References Cited

U.S. PATENT DOCUMENTS

| | | | | |
|---|---|---|---|---|
| 4,072,285 | A * | 2/1978 | Greenwood | 248/48.2 |
| 4,411,108 | A * | 10/1983 | Kerester | 52/11 |
| 4,807,406 | A * | 2/1989 | Densmore | 52/11 |
| 5,274,965 | A * | 1/1994 | Jackson | 52/11 |
| 5,357,719 | A * | 10/1994 | Lewis | 52/11 |
| 5,548,931 | A * | 8/1996 | Bryant | 52/11 |
| 5,893,239 | A * | 4/1999 | Leahy | 52/11 |
| 5,896,706 | A * | 4/1999 | Pike | 52/11 |
| 2009/0229191 | A1 * | 9/2009 | Petrov | 52/16 |
| 2009/0249702 | A1 * | 10/2009 | Desotell et al. | 52/11 |

* cited by examiner

*Primary Examiner* — Brian Glessner
*Assistant Examiner* — Omar Hijaz

(57) ABSTRACT

This new design assembly consisting of two brackets with a round tube, that is mounted on to the roof fascia, the bracket with a single one side round tube is mounted at the far end of the fascia, and the bracket with the double sided tube is mounted on the fascia approx. 10 feet apart. Using the hole in the end cap install the gutter assembly over the round tube on the bracket so that it rotated freely. Install a rain cover over the bracket. The pin is then removed from the bracket and the gutter assembly rotates from a horizontal location to a down position to clean out leaves and debris. After cleaning, the gutter is rotated back to its horizontal location and the pin is reinserted. The rain water will flow trough the bracket tube and out the downspout.

3 Claims, 7 Drawing Sheets

SELF CLEANING GUTTER SYSTEM

DRAWINGS

Figure 3:
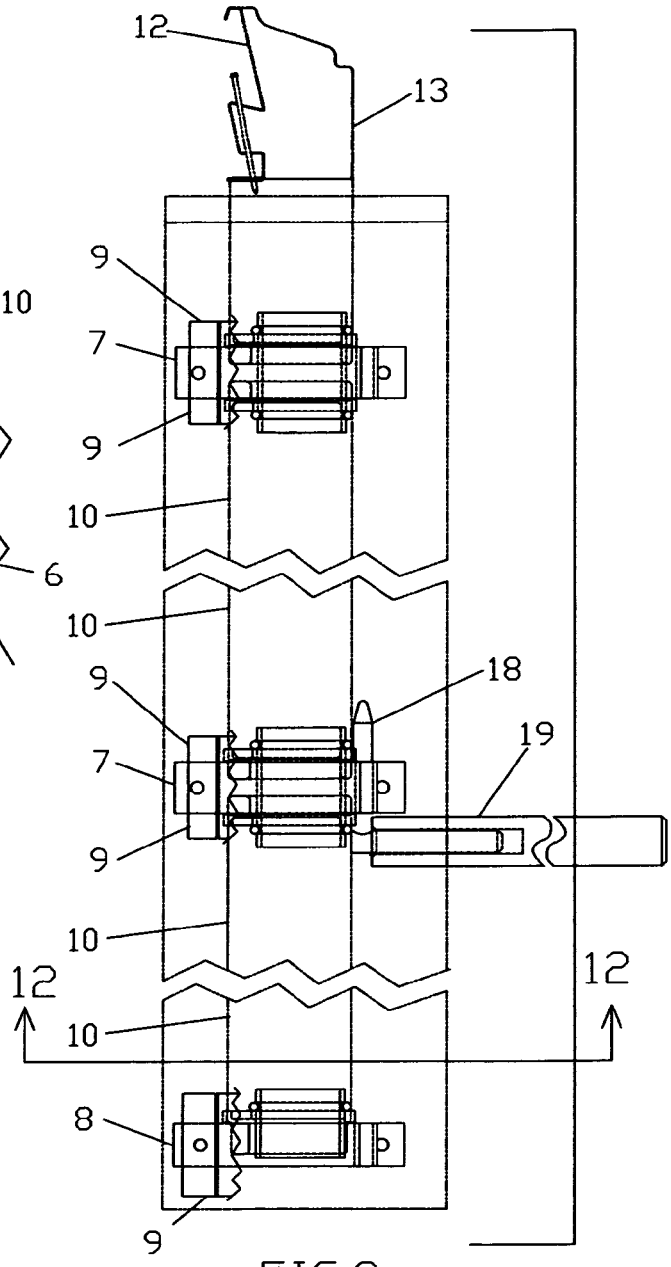
Figure 4:
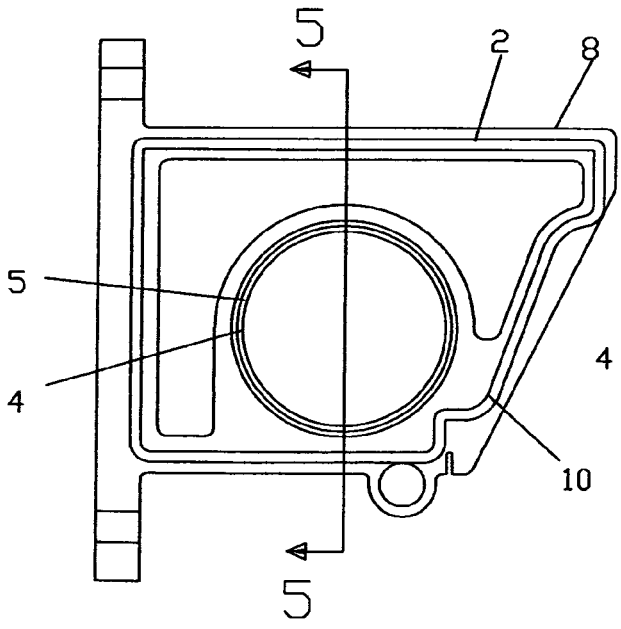

FIG. 3 Is a side view showing bracket 26, 27, mounted at the roof fascia including 28, 29, 30, 32, 33, 38, 39, FIG. 4 Is a front view showing bracket 27, including 20, 23, 24, 27, 30

Figure 5:
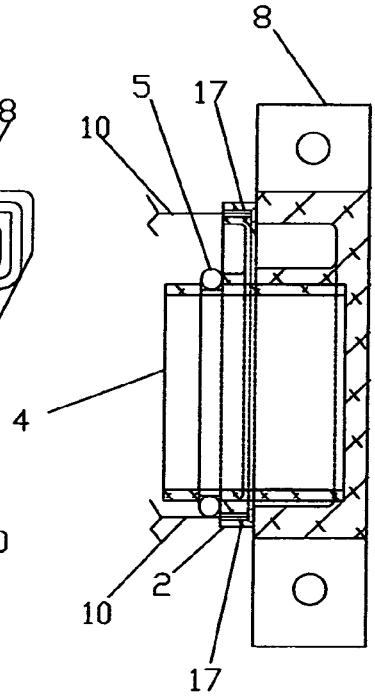

FIG. 5 Is a side view section showing bracket 27 thereof.

Figure 6:
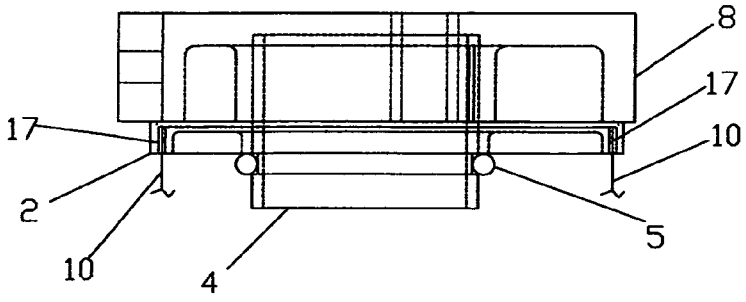

FIG. 6 Is a top view showing bracket 27 thereof

Figure 7:
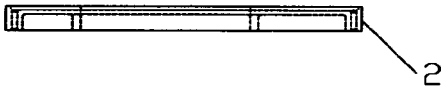

FIG. 7 Is a front view showing gutter end cap 21

Figure 8:
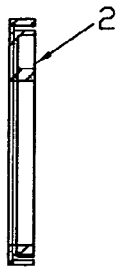

FIG. 8 Is a side view section end cap 21 thereof

Figure 9:
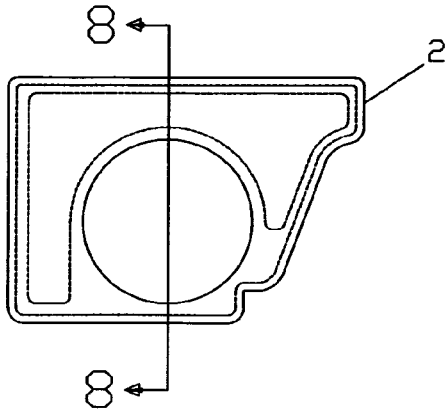

FIG. 9 Is a top view end cap 21 thereof

Figure 10:
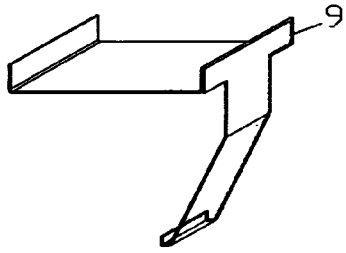

FIG. 10 Is a perspective view of the rain cover 10 Alum. sheet

Figure 11:
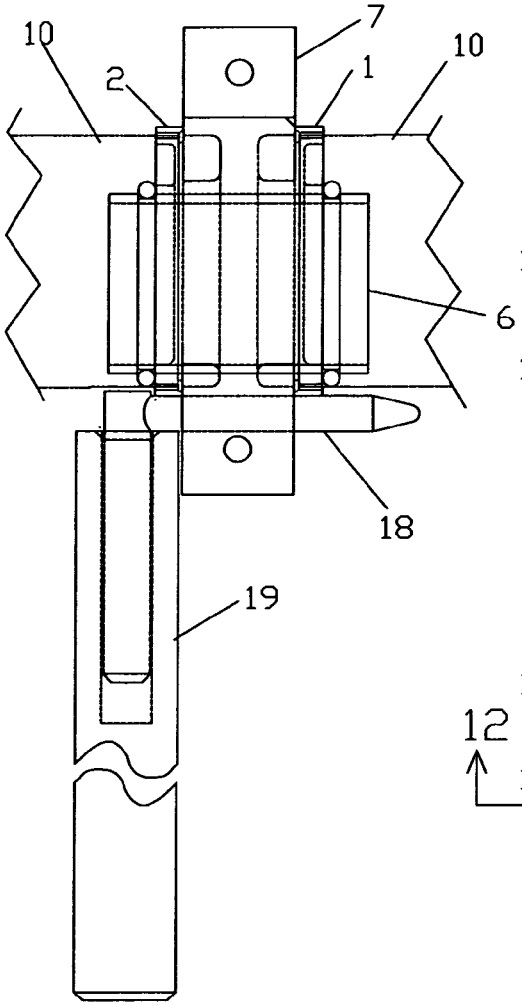

FIG. 11 View showing pin 18 in the bracket 7 and 8 including 1, 6, 10, 18, 19

Figure 12:
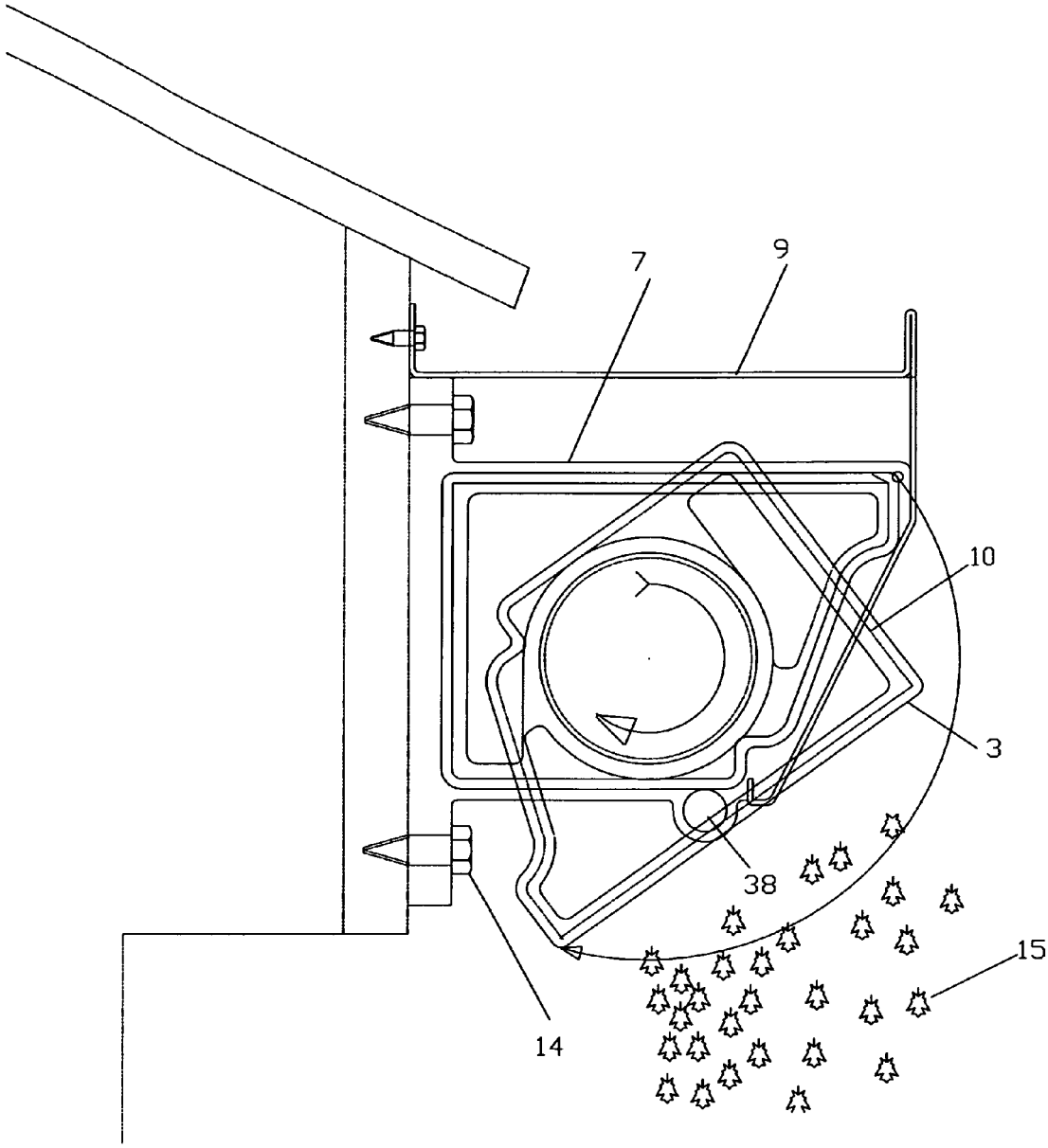

FIG. 12 Is a side elevation showing bracket 7 including 3, 9, 10, 14, 15

Figure 13:
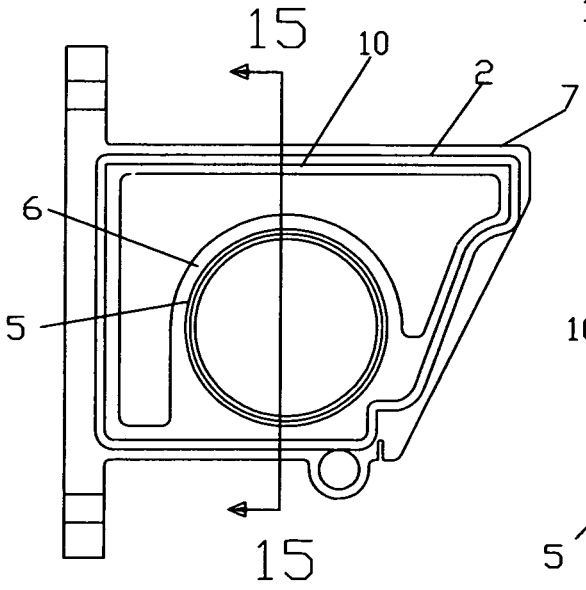

FIG. 13 Is a front view of the bracket 2, 5, 6

Figure 14:
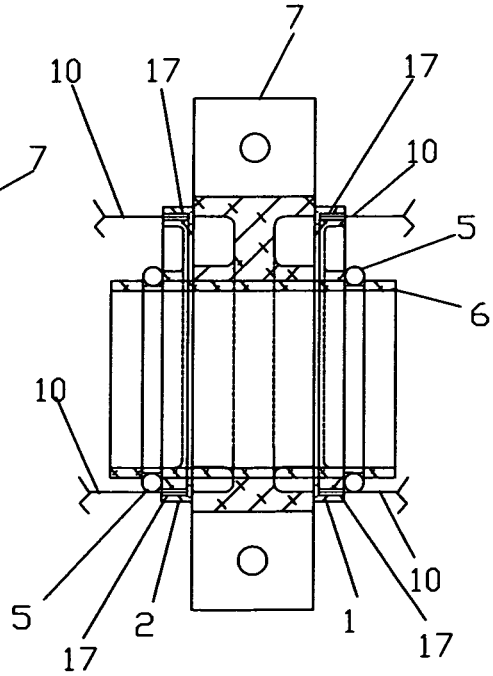

FIG. 14 Is a side view section of the bracket 7 including 1, 2, 5, 6, 10, 17

Figure 15:
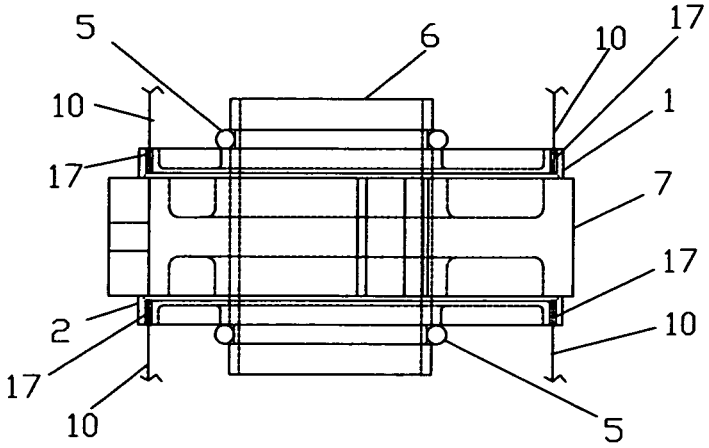

FIG. 15 Is a top view of bracket 7 thereof

Figure 16:
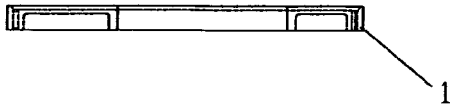

FIG. 16 Is a front view of gutter end cap 1

Figure 17:
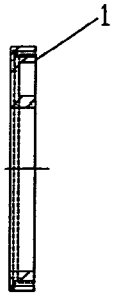

FIG. 17 Is a side view section of gutter end cap 1

Figure 18:
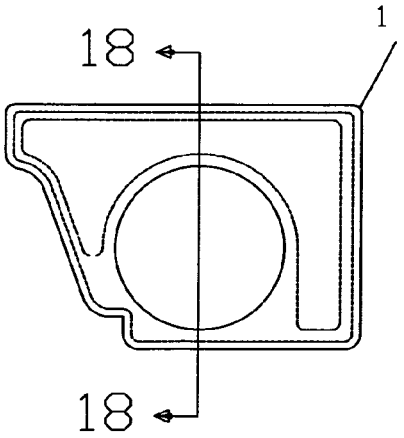

FIG. 18 Is a top view of gutter end cap 1

REFERENCE NUMBERS

21 gutter end cap new
22 gutter end cap
23 round tube new
24 o-ring new
25 round tube new
26 gutter bracket new
27 gutter bracket new
28 rain cover guard new
29 rain cover guard new
30 gutter
31 gutter end with drop outlet
32 hidden gutter hanger
33 gutter inside corner
34 screws new
35 leaves and debris
36 roof fascia
37 gutter seam sealer new
38 pin new
39 pin extension new

SPECIFICATION

Figure 1:
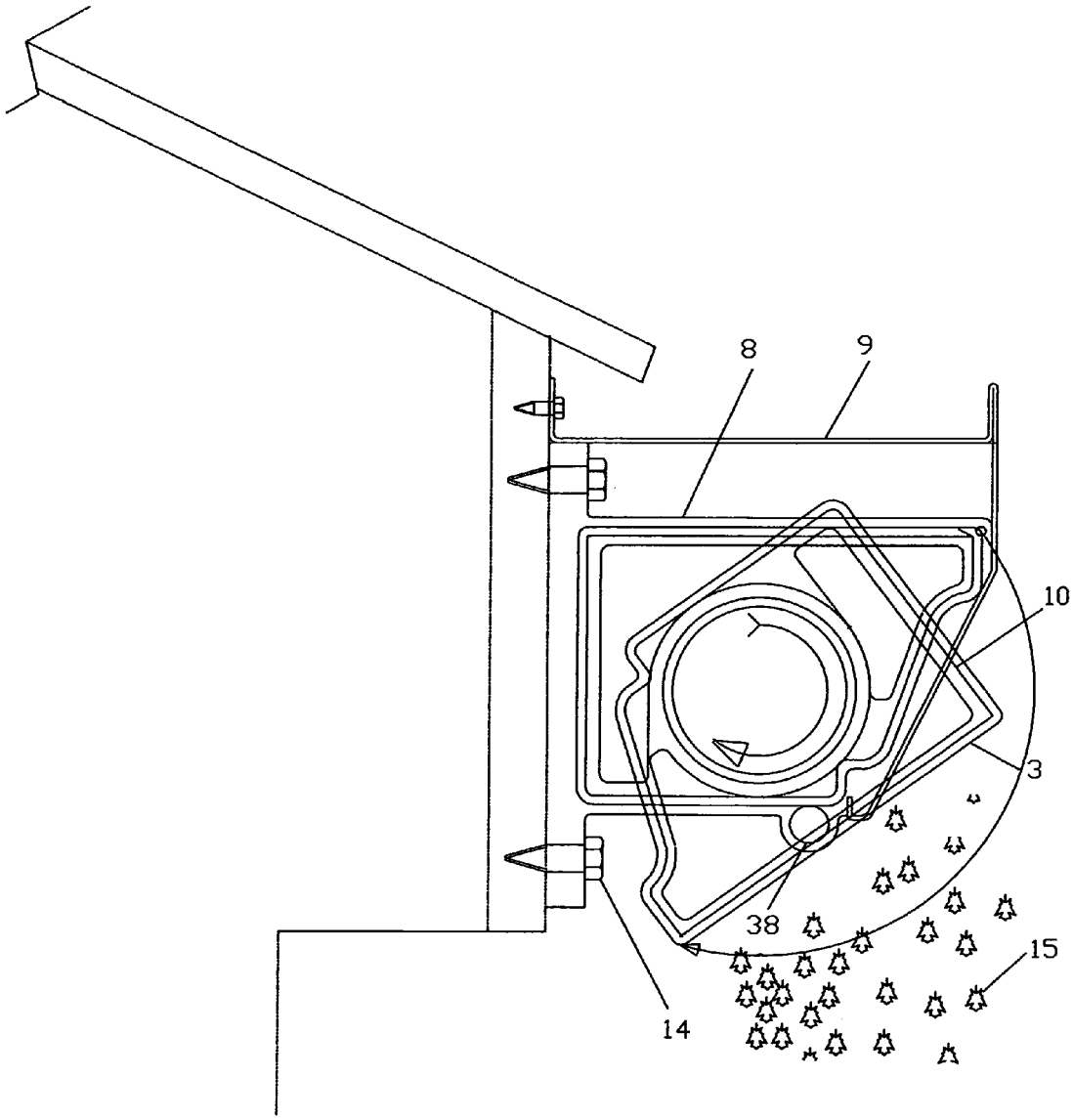
FIG. 1 Is a side elevation showing bracket 27, including 29, 30, 20, 34, 35

FIG. 1 Side view of the bracket 27 mounted with screws 34 on to the roof fascia with the rain cover 29 being attached to the lower part of the bracket and mounted on to the roof fascia. Showing end cap 20, gutter 30, the hole in the bottom of the bracket is for pin 38, Standing at the ground level remove the pin 38 from the hole in the bracket and then rotate gutter assembly from a horizontal location to a tilted down position to clean out leaves and debris, after cleaning return gutter assembly to its horizontal location and reinsert pin 38 trough the hole in the bracket the rain water will flow trough the tube and downspout.

Figure 2:
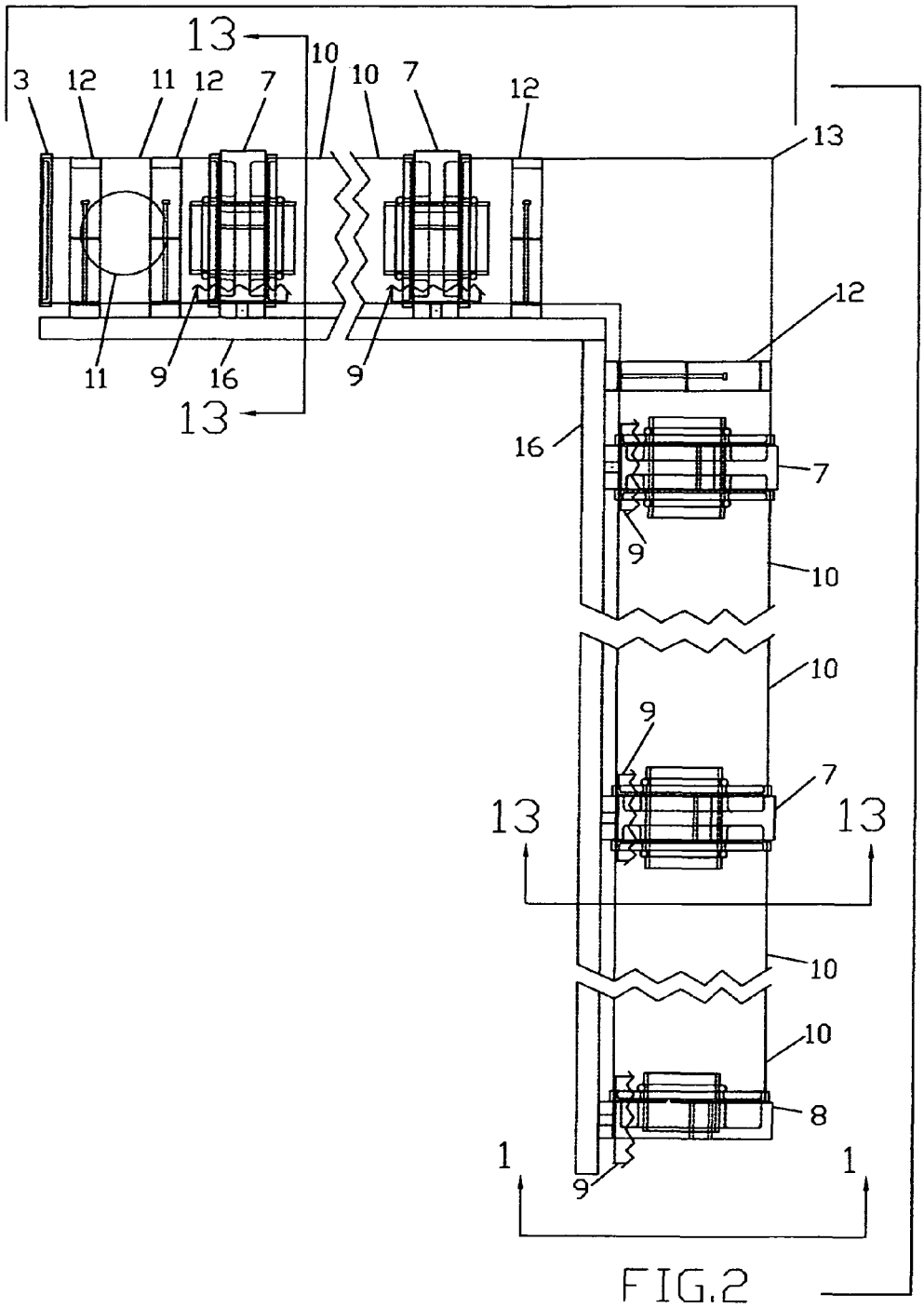
FIG. 2 Is a top view showing bracket 26, 27, mounted at the roof fascia including 28, 29, 30, 33, 32, 31, 22

FIG. 2 A top view of the bracket 26 and 25 assembly mounted to the roof fascia approx. 10 feet apart including the rain cover 28 and 29, gutter 30, end drop 31, gutter outside corner 33 are attached to the end cap 20 and 21 on the bracket 26 and 27. Hanger 32 is attached to the roof fascia included with gutter end drop 31, gutter outside corner 33 and end cap 22.

FIG. 3 Is aside view showing bracket 26 and 27 assembly attached to the roof fascia approx. 10 feet apart including the rain cover 28 and 29, gutter 30, gutter corner 33 are attached to the end cap 20 and 21 on the bracket 26 and 27 Hanger 32 mounted to the roof fascia included with the gutter outside corner 33, showing pin 28 and 29 being inserted into bracket 26 and 27.

FIG. 4 A front view assembly of the bracket 27 alum. material, showing round tube 23, end cap 20, seal ring 24 and gutter 30.

FIG. 5 Is a section assembly of the bracket 27 with round tube 23 aluminum material, showing end cap 20 attached to the edge of gutter 30 and secured with gutter seam sealer, install 20 and 30 as an assembly over the tube 4 and secure with seal ring 4

FIG. 6 Is a top view of the bracket 8 thereof

FIG. 7 Is a front view of the end cap 2 having a flanged diameter hole for use to fit over the tube 4 and 6 to rotate freely. The outer edge of end cap 2 have a slot for use to install gutter 10 and secure it with gutter seam sealer17.

FIG. 8 Is a side view section thereof

FIG. 9 Is a top view thereof

FIG. 10 Rain cover

FIG. 11 Shows the bracket 8 and pin 18 held against the end cap 1 and 6 to hold the assembly at it horizontal location when not tilted to a vertical position for cleaning FIG. 12 Side view of the bracket 7 mounted with screws 14 on to the roof fascia with the rain cover 9 being attached to lower part of bracket and mounted on to the roof fascia showing end cap 2, gutter 10 including the Hole for pin 18 Standing at the ground level remove the pin 18 from the hole in the bracket, rotate the gutter assembly from a horizontal location to a tilted down position to clean out leaves and debris, after cleaning return gutter assembly to its horizontal location and insert 18 trough the hole in the bracket and the rain water will flow trough the tube opening and out the downspout.

FIG. 13 A front view assembly of bracket 7 aluminum, a round tube 6, end cap 2, seal ring 5 and gutter 10

FIG. 14 Is a section assembly of the bracket 7 aluminum with a press fit round tube 6, showing end cap 1 and 2 installed over and a round tube 4 and 6 for use to rotate gutter assembly freely, attached gutter 10 with the end cap 1 and 2 and secure with gutter seam sealer.

FIG. 15 Is a top view of the bracket 7 thereof

FIG. 16 Is a front view of end cap 1 aluminum having a flanged diameter hole to fit over the round tube 4 and 6, on the outer edge a slot is used to attached the gutter 10 outer edge with the end cap 2, secure with seam sealer 17.

The invention claimed is:

1. A gutter assembly comprising:

a gutter bracket comprising:

a back plate with fastener apertures such that said back plate is adapted to be mounted to a roof fascia via said fastener apertures; said back plate having a center web portion with a first face and an opposing second face, whereby a circular aperture extends through said center web portion from said first face to said second face;

a cylindrical hollow tube having a diameter, a first tube edge and a second tube edge, whereby said cylindrical hollow tube is fitted snugly within said circular aperture; whereby said first tube edge extends beyond said first face and said second tube edge extends beyond said second face; whereby rain water is adapted to flow through said cylindrical hollow tube;

a locking pin aperture adjacent a lower edge of said center web portion and a locking in adapted to be inserted into said locking in aperture;

an end cap comprising:

a circular opening having a diameter which corresponds to said cylindrical hollow tube diameter; whereby said circular opening of said end cap is connected to said first tube edge or said second tube edge; a groove along the entire perimeter of said end cap; said groove adapted to receive the end of a roof gutter;

an o-ring positioned around said cylindrical hollow tube and adjacent to said end cap; and whereby said end cap is rotatable from a first horizontal position to a second vertical position so as to allow for cleaning of the roof gutter, whereby when said locking pin is inserted in said locking pin aperture, said end cap is locked in said first horizontal position, and when said locking pin is removed, said end cap is rotatable to said second vertical position.

2. The gutter assembly of claim 1, wherein multiple cutter brackets are spaced apart at 10 foot intervals along said roof fascia.

3. The gutter assembly of claim 1, further comprising a bracket cover which is adapted to be mounted to said roof fascia to cover said gutter bracket.

* * * * *